US007175231B2

(12) United States Patent
Gallo

(10) Patent No.: US 7,175,231 B2
(45) Date of Patent: Feb. 13, 2007

(54) MULTI-FUNCTION ADJUSTABLE TOWEL HEAD REST FOR BEACH CHAIR

(75) Inventor: Adrienne Gallo, Media, PA (US)

(73) Assignee: Adrienne D. Gallo, Media, PA (US)

( * ) Notice: Subject to any disclaimer, the term of this patent is extended or adjusted under 35 U.S.C. 154(b) by 106 days.

(21) Appl. No.: 11/118,278

(22) Filed: Apr. 28, 2005

(65) Prior Publication Data

US 2006/0255634 A1 Nov. 16, 2006

(51) Int. Cl.
*A61G 15/00* (2006.01)

(52) U.S. Cl. ..... 297/220; 297/219.1; 297/228.1; 297/228.11; 297/218.1; 297/218.5

(58) Field of Classification Search ..... 297/220, 297/219.1, 218.1, 218.15, 184.1, 184.11, 297/223, 221, 228.1, 228.11
See application file for complete search history.

(56) References Cited

U.S. PATENT DOCUMENTS 2,467,468 A * 4/1949 Duby et al. ..... 297/219.1
2,804,914 A * 9/1957 Butcko et al. ..... 297/229
4,253,701 A * 3/1981 Kifferstein ..... 297/220
4,600,238 A * 7/1986 Goodford ..... 297/219.1
4,723,814 A * 2/1988 Hunt ..... 297/219.1
4,790,592 A * 12/1988 Busso et al. ..... 297/184.11
5,330,251 A * 7/1994 McGuire ..... 297/229
5,331,956 A * 7/1994 Bailey ..... 128/202.13
5,829,828 A * 11/1998 Asfaw ..... 297/219.1
5,906,413 A * 5/1999 Yang ..... 297/284.5
5,944,384 A * 8/1999 Patterson ..... 297/344.23
6,490,768 B1 * 12/2002 Goodall ..... 24/334
6,659,551 B1 * 12/2003 Arenas ..... 297/229

* cited by examiner

*Primary Examiner*—Peter M. Cuomo
*Assistant Examiner*—Erika Garrett
(74) *Attorney, Agent, or Firm*—Donald W. Meeker

(57) ABSTRACT

A padded roller fits slidably into the back of a recreational chair. A spring loaded elongated padded scissors clamp or hook and loop fasteners on a covering fabric around a padded core alternately receive, retain and release a towel. The roller attaches slidably to the frame of the chair in grooves having multiple stops for adjusting the height of the roller. The towel unrolls to cover the seat or hang over the back of the seat to dry and may be released from the roller to dry a user or cover a user on the chair.

8 Claims, 4 Drawing Sheets

MULTI-FUNCTION ADJUSTABLE TOWEL HEAD REST FOR BEACH CHAIR

BACKGROUND OF THE INVENTION

1. Field of the Invention

The present invention relates to a headrest cushion, and more particularly to an adjustable cushioned headrest made from a rolled up towel, which is secured to the seat back of an outdoor chair and may be unrolled and spread in a forward direction to place under the user on top of the chair or spread backward to hang down from the chair to dry or removed from the roll on the chair to dry the user after swimming or to cover a user on the chair.

2. Description of the Prior Art

Many recreational activities involve outings to beaches and other pleasant locations, where people can picnic, play, and rest on the ground or on lounge chairs, recliners, and the like. In particular, many people enjoy a day at the beach, lying on the sand in the sun. For many people, it is comfortable to place a padded item such as a rolled-up beach towel or pillow under their necks for support as they lie supine on the beach or as they lie on a lounge chair or recliner.

The prior art provides many head rest devices, but none with a rolled up headrest with multi-functional features including use as a towel and beach blanket.

U.S. Pat. No. 5,944,384, issued Aug. 31, 1999 to Patterson, shows a sun following swivel beach chair that includes a towel attached at one end to an upper end of the backrest portion of the supporting means, so that in a first instance said towel can be rolled up to function as a headrest for the person in said supporting means, and in a second instance said towel can be unrolled to function as a head cover to protect the head of the person from the rays of the sun. FIG. 7 shows a towel rolled into a head read which can also be used as a head cover.

U.S. Pat. No. 5,150,945, issued Sep. 29, 1992 to Aupperlee, indicates a removable vehicular child seat cover that covers all areas of the seat when unoccupied. A combined storage pouch/pillow is attached to the upper or backrest portion of the cover. While the upper portion of the cover remains attached to the safety seat, the balance of the cover may be removed from the seat and stuffed into the pouch with one hand to form a soft pillow for the child's head. The position of the pouch may be adjusted on the cover to accommodate the child's growth. The balance of the cover may be removed from the pouch and applied to completely cover the child seat with one hand. There are no problems with misplacing the cover since the upper portion remains attached to the child seat in both the covered and uncovered mode. Arrangements for holding the cover in place on the child seat are provided.

U.S. Pat. No. 6,126,237, issued Oct. 3, 2000 to Ritterhouse, is for an adjustable assembly for securing a rolled up towel that serves as a cushion in a plurality of positions on the seat back of a lawn chair. In a preferred embodiment, two adjustable assemblies are used to secure the cushion to the seat back. One assembly is secured to each side of the seat back.

U.S. Pat. No. 6,182,309, issued Feb. 6, 2001 to Sullivan, concerns a beach towel-pillow apparatus that allows a user to rest comfortably on a beach towel while his or her head is supported by a cylindrically-shaped pillow, permanently affixed to one end of the towel portion of the apparatus. One or more elastic securing straps are affixed to one end of the apparatus and are used to secure the towel portion when it is wrapped around the pillow thereby allowing for easy storage and transporting of the apparatus. An adjustable carrying strap, much like a belt, is affixed to one end of the pillow allowing for a user to sling the carrying strap over his or her shoulder for easy carrying of the apparatus once the towel has been secured around the pillow by the securing straps. A pillow covering with a zipper hidden from view by a portion of the covering encloses the pillow, allowing for easy insertion and removal of the pillow.

U.S. Pat. #D456,158, issued Apr. 30, 2002 to Van Severen, illustrates the ornamental design for a chaise, which has an adjustable head rest.

U.S. Pat. No. 5,297,304, issued Mar. 29, 1994 to O'Sullivan, provides a roll-up body support cushion. The cushion has a length and a width and is flexible such that it can be rolled up in a direction substantially parallel to its long sides. At least one strip of a releasable fastening device is secured to the first opposed surface of the cushion. The strip of releasable fastening material is positioned substantially parallel to the length of the cushion. At least one strip of a complementary releasable fastening device is secured to the second opposed surface of the cushion. The strip of complementary releasable fastening device is positioned substantially parallel to the length of the cushion and in juxtaposition to the respective strip of releasable fastening device secured to the first opposed surface. The rolled-up cushion may be positioned on a conventional automobile seat, by placing the strap around the head rest.

U.S. Pat. No. 5,275,463, issued Jan. 4, 1994 to Rocha, is for a lounge chair cover which can be rolled up and fastened so as to be carried like a duffel bag, the cover including a panel to cover the top of the chair back, seat, and leg rest portions, having a hood pocket into which the top of the back portion of the chair fits, a pocket member hanging from the top that serves as an attached pillow cover which can be filled with a towel or pillow; a lateral back strap to stretch the cover taut across the back portion, and spaced strap members on the lower leg portion releasably connected together, preferably by hook and loop fasteners, longitudinal strap members along the lateral edges of the lower part of the main panel to fasten the panel smoothly and tautly to the leg rest portion of the chair; a pair of side pockets hanging downwardly from opposite sides of the seat portion of the cover, a pair of strap handles and cross reinforcing straps, and a strap closure member to hold the cover in a rolled form of a duffel bag with all pockets and their contents inside the roll.

U.S. Pat. No. 3,279,849, issued Oct. 18, 1966 to Radke, claims a bolster-type cushion which is rectilinearly, vertically adjustable on the back of a seat. The cushion is removably and adjustably affixed to the back of the seat by means of a hook and loop arrangement or by a strap that encircles the back of the seat.

U.S. Pat. No. 5,503,456, issued Apr. 2, 1996 to Rossini, describes a headrest adapted to be removably mounted on a chair. In a preferred embodiment, the headrest comprises a pillow. The pillow comprises an insert and a case, the insert being removably housed within the case. The headrest also comprises a pouch which is appropriately sized and shaped to removably receive therewithin the pillow or other small items, such as a pair of sunglasses, a wallet or the like. The headrest further comprises three flexible, stretchable straps. A first of the three straps is attached at one end to the pillow and at the opposite end to the pouch. A second of the three straps is attached at one end to the pillow. A third of the three straps is attached at one end to the pouch. The free ends of the second and third straps are removably connected to one another by a buckle. The headrest of the present invention may be used to secure a towel to a chair.

U.S. Pat. No. 6,782,572, issued Aug. 31, 2004 to Jones, puts forth a multi-use pillow having adjustable positioning features. The multi-use pillow includes a body member of generally cylindrical geometry having at least two elongated flat attachment strips, each preferably comprising a loop fastener material on one surface of the strip and having a smooth surface on the opposite side surface of the strip, and being attached to the outer surface of the body member with their respective loop-bearing surface exposed outwardly. At least one, and preferably two mounting straps, each having a first surface bearing a loop fastener material thereon, except for a short length of hook fastener material adjacent one end of the strap, and a second surface bearing a hook fastener material thereon, is anchored at one of its opposite ends to the body member at a location adjacent one of the opposite ends of the body member, with the remainder of the strap extending unsupported from the body member a distance that is equal to at least about the length of the body member, and preferably a multiple, preferably two to three multiples, of the length dimension of the elongated body member whereby the mounting strap is suitable for releasably mounting the pillow to a support such as the frame of a chair, etc.

U.S. Pat. # D385,452, issued Oct. 28, 1997 to Marti, provides the ornamental design for a beach pillow which has a carrying strap and a means for holding a rolled up beach towel.

U.S. Pat. No. 5,240,330, issued Aug. 31, 1993 to Thompson, shows a combination cushion and organizer. A beach chair bundle is provided that includes first, second, third, and fourth panels of terry cloth. The second and third panels are joined by an elastic strip. The second panel is folded up on the first and fastened to it along side edges to form a pouch for a removable pillow. The third panel extends over the pillow pouch and down over the first panel to form an inverted envelope adapted to slip over a chair back. The fourth panel is folded up on the third and fastened to it along side edges to form a utility pocket. A flap cover and fastening strips hold the pocket closed. Tie loops connect the pillow pouch to the utility pocket, through the chair structure, to secure the beach chair bundle to the chair. A fastening strip across the lower exterior of the first panel, and a zipper half across the bottom exterior of the utility pocket provide for attachment of a towel and a bag respectively.

What is needed is a rolled up headrest attached to an outdoor chair or lounge with multi-functional features including use as a towel and beach blanket and a towel drying position.

SUMMARY OF THE INVENTION

An object of the present invention is to provide a rolled up towel forming a headrest attached to an outdoor chair or lounge with multi-functional features including use as a towel removed from the roll or as a sun shade or warming cover for a person in the chair and a beach blanket type cover for the chair or lounge to rest on and a hanging towel drying position.

In brief, an adjustable, padded headrest for a portable recreational chair is provided with a clamp for receiving, retaining, and releasing a towel that may be rolled up to form an absorbent, more padded headrest, or unrolled to drape over the chair, allowing the user to rest on it, or unrolled and hung over the top bar of the chair to allow the towel to dry. The towel may be released and used to dry off the user.

An advantage of the present invention is that it provides a rolled up towel forming a headrest attached to an outdoor chair or lounge. with multi-functional features including use as a towel removed from the roll and a beach blanket type cover for the chair or lounge and a hanging towel drying position.

Another advantage of the present invention is that it is adjustable to a variety of positions to provide a comfortable head rest for many different body types.

An additional advantage of the present invention is that it allows the towel to be unrolled to drape over the recreational chair or lounge for a user to rest on.

One more advantage of the present invention is that it allows the towel to be unrolled and hung over the top bar of the chair or lounge to dry.

Yet another advantage of the present invention is that it can completely release the towel so that a user can utilize the towel to dry off.

A related object of the present invention is that the towel can be removed to cover a person on the beach chair in cool, breezy weather or shade the body from the sun.

A further advantage of the present invention is that it insures that a person going to the beach with the beach chair will always have a beach towel.

Still another advantage of the present invention is that it is easy to operate.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
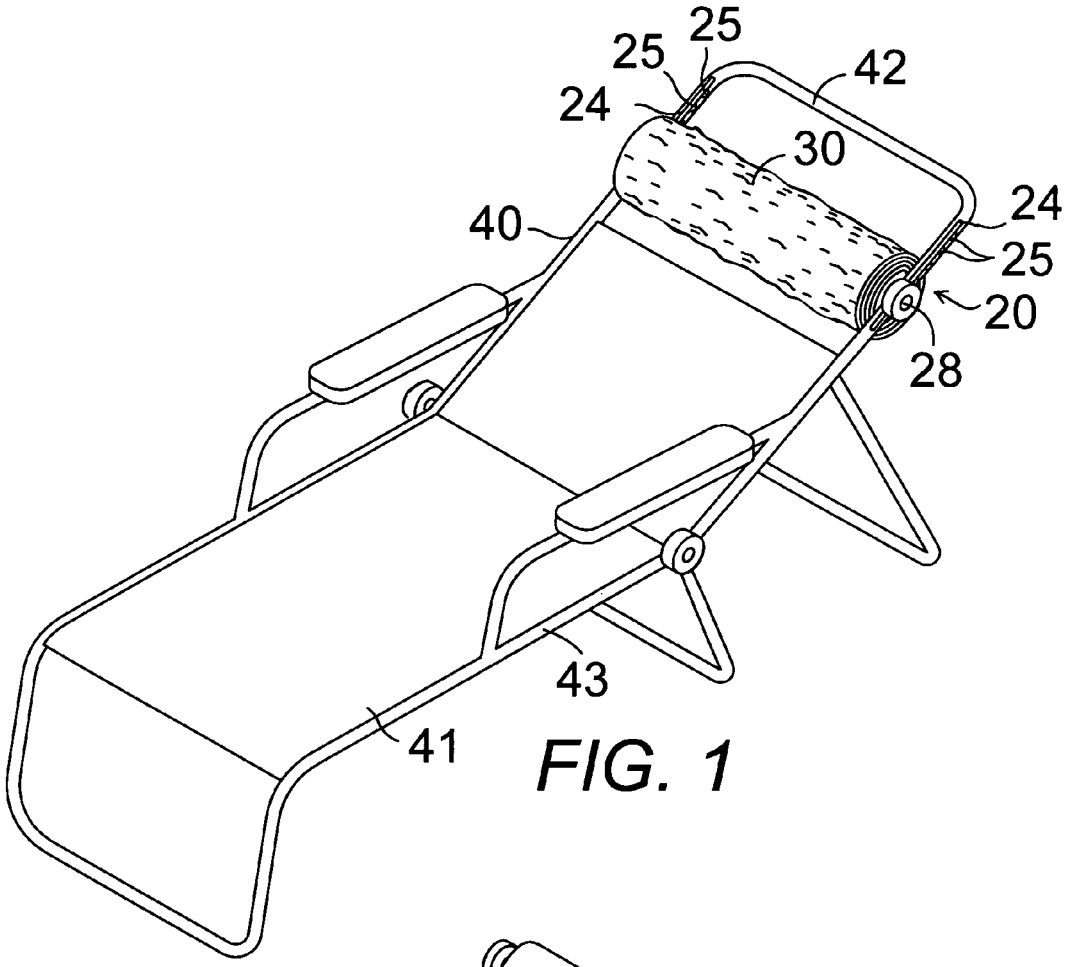
FIG. 1 is a perspective view of one type of portable lounge seat having the rolled towel headrest of the present invention adjustably slidable in slots in the upper frame to adjust the height of the headrest, with the towel rolled completely around the headrest.

In FIGS. 1 through 7, a multi-function towel headrest device for a portable recreational seat 40 comprises a padded roller 20 and 20A that receives a beach towel 30 rolled around the roller to form a headrest adjustable in various positions.

The padded roller 20 and 20A is attached to an upper backrest portion of a frame 43 of a portable recreational seat 40, such as a portable lounge having a seat frame 43 and seat cover 41. The roller 20 and 20A fits rotatably in the frame and can be turned to roll a beach towel 30 around the padded roller to form an enlarged head rest.

Figure 2:
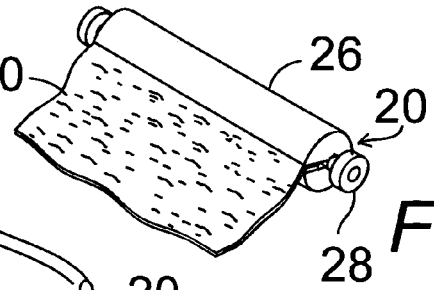
FIG. 2 is a perspective view of the preferred embodiment of the padded roller of the invention with the full-length padded clamp closed around an end of a towel.
Figure 3:
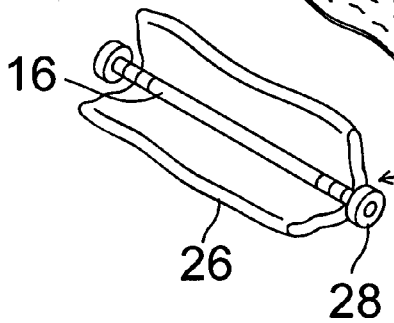
FIG. 3 is a perspective view of the preferred embodiment of the padded roller of the invention with the full-length padded clamp open to receive an end of a towel.
Figure 4:
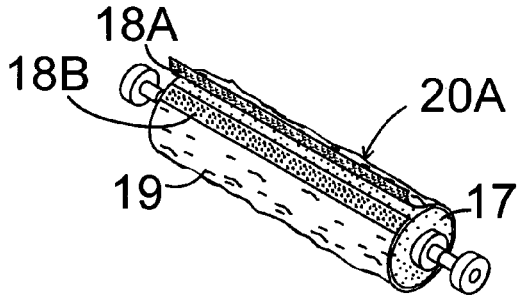
FIG. 4 is a perspective view of an alternate embodiment of the padded roller of the invention with a cloth cover attached by a hook and loop fastener around a foam cylinder surrounding the core of the roller.

In FIGS. 2 and 3, the padded roller 20 has a clamp 26 along a length of the roller. The clamp is openable to receive an edge of a beach towel inserted within the open clamp, as in FIG. 3, and the clamp is closable to retain the edge of the beach towel within the clamp, as in FIG. 2. A button in an end knob 28 controls the opening and closing of the clamp 26. The padded roller 20 is structured to turn on a central axis post 16 to roll the towel around the roller to form the enlarged headrest, as shown in FIG. 1.

The end extensions of the central post 16 of the padded roller 20 and 20A fits slidably within a pair of tracks 24, one in each of two opposing upper sides of the frame 43 of the recreational seat 40. The tracks each have a series of stops 25, such as notches in the tracks 24, to retain the padded roller at different heights, so that the padded roller may be moved up down in the track to adjust the roller to a comfortable headrest position for a user.

Figure 6:
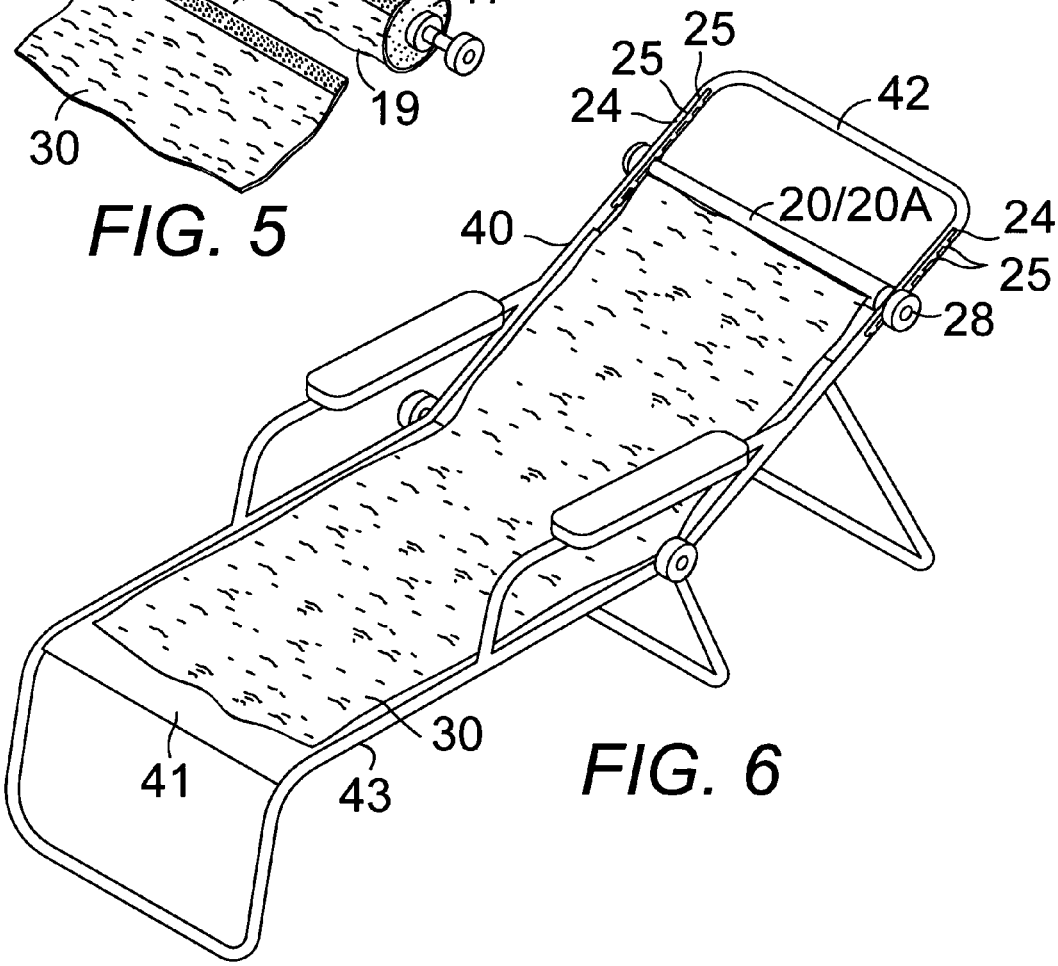
FIG. 6 is a perspective view of the type of portable lounge seat of FIG. 1 having the rolled towel headrest of the present invention adjustably slidable in slots in the upper frame to adjust the height of the headrest, with the towel unrolled and spread over the seat.
Figure 7:
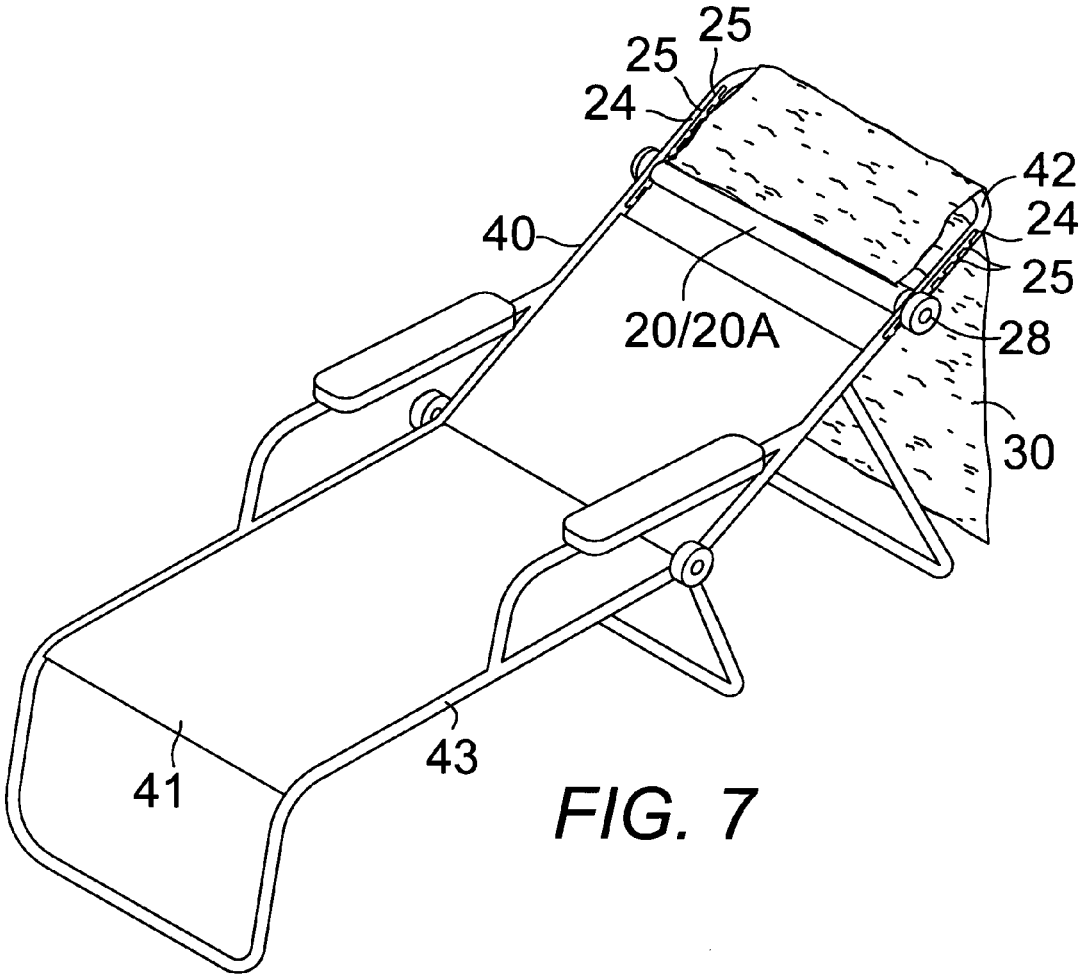
FIG. 7 is a perspective view of the type of portable lounge seat of FIG. 1 having the rolled towel headrest of the present invention adjustably slidable in slots in the upper frame to adjust the height of the headrest, with the towel unrolled completely and spread back over the top bar of the frame and hanging down in a drying position.
Figure 8:
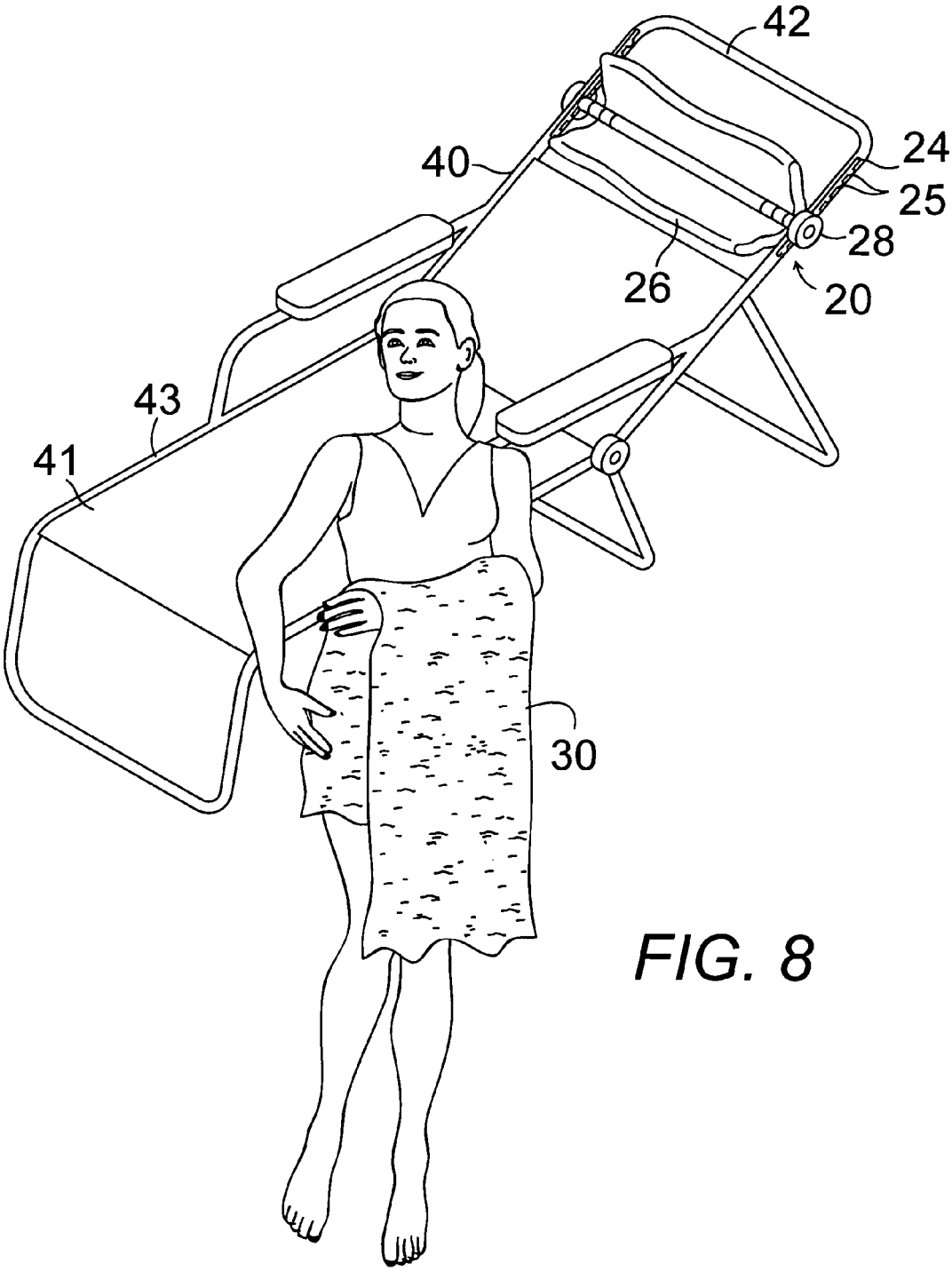
FIG. 8 is a perspective view of the type of portable lounge seat of FIG. 1 having the rolled towel headrest of the present invention adjustably slidable in slots in the upper frame to adjust the height of the headrest, with the towel removed from the padded roller for drying a user.

The roller 20 and 20A is adapted to be unrolled to allow the towel 30 to spread over the recreational seat 40 for a user to rest on, as in FIG. 6, or spread back to hang over the top bar 42 of the recreational chair to dry, as in FIG. 7. The roller clamp 26 is adapted to release the towel 30 for a user to use the towel to dry off, as in FIG. 8.

Figure 5:
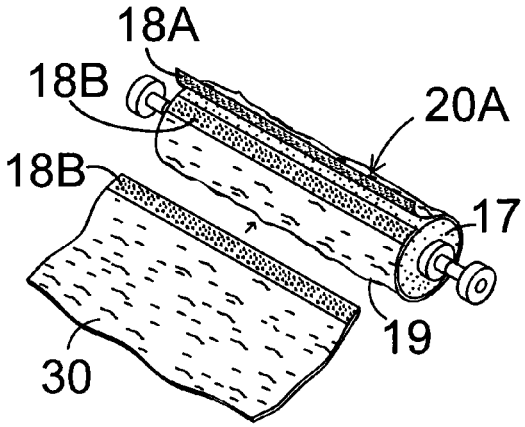
FIG. 5 is a perspective view of the alternate embodiment of the padded roller of FIG. 4 with the hook and loop fastener open to receive the end of a towel to secure the towel to the roller.

In FIGS. 2 and 3, the clamp 26 is a spring loaded elongated scissors clamp running a full length of the padded roller 20 covered with padding so that the roller serves as a comfortable neck rest without the towel. In an alternate embodiment, as in FIG. 4, In FIGS. 4 and 5, an alternate embodiment of the padded roller 20A comprises a cylinder of padded material 17, such as foam padding, a soft plastic core, Styrofoam or other soft padding, having a central shaft 16 of metal, wood, plastic or other rigid material through the entire length of the cylinder and the outside wrapped in a fabric 19 attached around the padded material by a hook and loop type pair of fasteners 18A and 18B removably attached together to hold the fabric and the padded material. In FIG. 5, a towel 30 may also be provided with one or both sides of the edge having a hook and loop fastener to mate with the hook and loop fastener 18A and 18B on the fabric 19 is in the edge of the material so the towel end is held in place by the hook and loop fasteners and the towel rolled around the roller 20A to form an enlarged padded head rest.

There is a protruding end extension of the central shaft 16 on each end of the roller 20A which fit into the tracks 24 in the frame 43 for a height adjustable padded headrest.

The padded roller 20 and 20A may have an internal spring which automatically turns upon pulling a connected towel 30 to roll the towel onto the roller.

In use, a beach towel 30 is inserted into the clamp 26 or hook and loop fasteners 18A and 18B on the padded roller 20 and 20A and rolled up to create a larger, more padded headrest on a portable recreational chair 40. The roller may contain an internal spring which automatically turns upon pulling a connected towel to roll the towel onto the roller. Upon pulling the connected towel, the roller unrolls the towel, which can then be draped over the recreational chair for the user to rest on, as in FIG. 6, or hung over the back of the chair to dry, as in FIG. 7. The clamp 26 or hook and loop fasteners 18A and 18B can be released to allow the towel 30 to be removed completely so that the user can utilize the towel to dry off, is in FIG. 8.

It is understood that the preceding description is given merely by way of illustration and not in limitation of the invention and that various modifications may be made thereto without departing from the spirit of the invention as claimed.

What is claimed is:

1. A multi-function towel headrest device for a portable recreational seat, the device comprising:

a portable recreational seat comprising a seat frame and a seat cover including an upper backrest portion;

a padded roller attached to the upper backrest portion of the portable recreational seat by a means for pivoting the padded roller so that the roller can be turned to roll a towel around the padded roller, the padded roller having a means for alternately attaching and releasing an edge of a towel configured along a length of the padded roller, the padded roller structured to turn on a central axis to roll the towel around the roller to form a headrest, the padded roller fitting slidably within a pair of tracks, one in each of two opposing upper sides of the frame above the upper backrest portion of the recreational seat, the tracks having a series of stops to retain the padded roller at different heights, so that the padded roller may be moved up down in the track to adjust the roller to a comfortable headrest position for a user, the padded roller configured to be alternately unrolled and spread forward to cover the recreational seat for a user to rest on the towel with the towel attached to the padded roller or unrolled and spread backward over a top of the seat frame to hang down behind the seat from a top of the frame to dry with the towel attached to the padded roller, or unrolled and released from the padded roller for a user to use the towel to dry off or to cover a user on the seat.

2. The device of claim 1 wherein the means for alternately attaching and releasing an edge of a towel comprises a clamp along a length of the roller, the clamp openable to receive an edge of a beach towel inserted within the open clamp and the clamp closable to retain the edge of the beach towel within the clamp.

3. The device of claim 2 wherein the clamp is a spring loaded elongated scissors clamp running a full length of the padded roller, the clamp covered with padding so that the roller serves as a comfortable neck rest without the towel.

4. The device of claim 2 wherein the padded roller further comprises a protruding end rod passing through one of the tracks on each side of the frame and further comprising a control knob on at least one of the end rods for opening and closing the clamp.

5. The device of claim 1 wherein the padded roller further comprises an internal spring which automatically turns upon pulling a connected towel to roll the towel onto the roller.

6. The device of claim 1 wherein the padded roller further comprises a protruding end rod on each end of the padded roller and each of the tracks comprises an elongated slot through one side of the frame and the stops comprise a series of spaced notches in the slot, each of the notches adapted to receive and retain the protruding end rod of the padded roller.

7. The device of claim 1 wherein the padded roller comprises a cylinder of padded material covered with cloth material, a central shaft through an entire length of the cylinder, the cylinder extending out each of two ends of the cylinder to fit slidably in the tracks and an external means for alternately attaching and releasing an edge of a towel.

8. The device of claim 7 wherein the external means for alternately attaching and releasing an edge of a towel comprises a hook and loop fastener attached to the cloth material covering the padded cylinder.

* * * * *